US005435562A

United States Patent [19]

Stock et al.

[11] Patent Number: 5,435,562

[45] Date of Patent: Jul. 25, 1995

[54] GOLF CLUB LASER ALIGNMENT DEVICE

[76] Inventors: Suzanne Stock, P.O. Box 3411, Rancho Santa Fe, Calif. 92067; Gerald P. Nordeman, 18505 Lookout Dr., Yorba Linda, Calif. 92686

[21] Appl. No.: 209,628

[22] Filed: Mar. 9, 1994

Related U.S. Application Data

[63] Continuation-in-part of Ser. No. 16,110, Feb. 10, 1993, abandoned.

[51] Int. Cl.[6] ..... A63B 69/36

[52] U.S. Cl. ..... 273/186.3; 273/194 R

[58] Field of Search ..... 273/186.3, 35 R, 183.1, 273/185 R, 186.2, 187.4, 187.6, 193 R, 194 R, 194 A, 35 A

[56] References Cited

U.S. PATENT DOCUMENTS 3,796,220 3/1974 Bredemeier .
3,802,709 4/1974 Elkins, Jr. .
3,953,034 4/1976 Nelson .
4,341,384 7/1982 Thackrey .
4,367,877 1/1983 Gibson et al. .
4,561,436 12/1985 Munnerlyn .
4,997,189 3/1991 Perkins .
5,029,868 7/1991 Cloud .
5,042,815 8/1991 Sutton .
5,165,691 11/1992 Cook .
5,169,150 12/1992 Tindale .
5,193,812 3/1993 Hendrickson .
5,213,331 5/1993 Avanzini .
5,217,228 6/1993 De Aguilar ..... 273/186.3

*Primary Examiner*—Mark S. Graham
*Attorney, Agent, or Firm*—Nydegger & Associates

[57] ABSTRACT

A golf club having a laser generating diode and a laser reflecting prism mounted in the hosel for emitting a laser beam perpendicular to the shaft of the club. The laser generating diode is energized by a battery in the grip of the club, through a switch on the grip. The laser beam emitted from the hosel demonstrates the direction in which the club face is aligned.

5 Claims, 2 Drawing Sheets

48
46
50
44
10
52
54
18
56
19
38
40
38
14
32
60
42

48
5
10
46
50
44
30
52
54
18
56
58
38
42
40
60
32
5

GOLF CLUB LASER ALIGNMENT DEVICE

RELATED APPLICATIONS

This application is a continuation-in-part of application Ser. No. 016,110, filed Feb. 10, 1993, now abandoned for "Laser Putter".

TECHNICAL FIELD

The present invention generally pertains to apparatus for allowing a person to practice properly aligning a golf club for a stroke through a golf ball. More particularly, the present invention pertains to devices employing a laser light mounted on a golf club to inform a user if the club is aligned with a target. The present invention is particularly, but not exclusively useful, for improving the alignment of a putting stroke.

BACKGROUND OF THE INVENTION

In golf, it is known that putting is ultimately determinative of a low score. Practice does not necessarily make perfect. Multitudinous putting strokes, stances, grips, and clubs, for use either on putting greens or on carpeted areas, do not necessarily lead to improved and consistent putting strokes; each time the hole is missed, one merely knows one missed the putting cup, again. Eye-brain-hand-arm-feet coordination is not necessarily improved by practice; one only knows one missed, but not necessarily why.

It is well known that a person's misalignment of the head of a putter is a major reason for misdirecting a golf ball into a putting cup. Club misalignment can also have a major effect on performance when the golfer uses any other type of club. However, once a person strokes through a golf ball, no way exists to determine if club alignment was proper or improper. The present invention recognizes that many cumulative problems in the performance of most people would be corrected if the person knew, before stroking the ball, in what direction the club is aligned in relationship with a target.

Other persistent problems associated with putting arise because of gradient differentials between the location of the golf ball and the putting cup. In the world of putting, the shortest distance between two points is not always a straight line. Successful putting demands that eye-brain-hand-arm-feet symbioses adjust the orientation of the contact surface of the head of a putter to compensate for terrain and contour differences on the surface of a putting green. Again, no useful means exists for confirming the precise orientation of the club before stroking in such an environment. The present invention recognizes this problem.

It is recognized that any solution to these problems must be achieved using a practice club similar to the club the golfer would typically use. In addition, the solution for these problems must offer a practice device which can prompt a person to make corrections to the club alignment before, not after, a stroke. Further, the practice device should quickly and easily show whether club alignment is proper or improper. Also, the practice device should quickly and easily provide a mark on a target which, in the case of an uneven putting surface, provides a known point at which to aim. After stroking at such a known point on a target, the user of the practice device will be prompted to realign the putter if the stroke caused the golf ball to miss the cup or hole. The known point must be fixed by the practice device with relative precision. At the same time, the known point must be bright and visible to the user for useful distances, preferably at least one hundred feet between the user and the target, which may be behind the hole or cup.

Laser lights, because of their controllable and highly directional beams of light, offer a useful solution. The present invention recognizes that it would be useful to emit a stimulated, coherent light beam from the club at a target before, not after, stroking a golf ball. The golfer may follow the golfer's usual procedures for addressing the ball. Feet will be positioned and aligned; hands will grip the club in the usual way; eyes will scan the terrain between the club and the target; and the golfer will coordinate the alignment in preparation to stroke the golf ball. Then the golfer may switch on the laser light, which should be aligned with the club in an way suitable to the given club. The golfer will determine instantly if the club is properly aligned, by observing the point of impact of the laser beam near a chosen target. On contoured putting surfaces, the laser light system can be aimed at a point on the target which the golfer has selected to compensate for differences in elevation and inclination between the golf ball and the target or putting cup. After stroking through the ball at the point on the target, the golfer knows if the golfer compensated appropriately for such contour differences.

In light of the above, it is an object of the present invention to provide a device which allows a golfer to practice properly aligning a golf club before stroking through the ball. Yet another object of the present invention is to provide a device for allowing a golfer to practice properly aligning a golf club, which is relatively easy to manufacture, easy to operate, and comparatively cost effective.

SUMMARY OF THE INVENTION

A device is provided to allow a person to properly align a golf club prior to a stroke. In accordance with the present invention and for exemplary purposes only, a preferred embodiment of the practice device comprises a golf club having a head with a contact surface formed on the head to strike a golf ball. The head is attached to a fitting at the distal end of the club shaft, called a hosel. A hand grip is attached to the proximal end of the shaft for holding the club. A switch is mounted on the grip. Preferably, the switch protrudes through the hand grip for ease of operation by the person using the device.

A laser light is mounted on the device. In the preferred embodiment of the present invention, a single laser is mounted in the hosel at the end of the shaft. As will be obvious to one of ordinary skill in the art, any number of laser lights may be mounted on the device.

In the preferred embodiment of the present invention, such as a putter, the contact surface of the head is substantially perpendicular to the surface on which the user is standing when the user has completed addressing the golf ball. In another type of club, the contact surface of the head of the club may be angled upwardly, to cause the ball to fly at an upward angle, theoretically in a vertical plane.

Further, in the preferred embodiment of the present invention, the laser is mounted in the hosel at the distal end of the shaft of the club and aimed so that the laser beam is emitted substantially perpendicular to the plane of the contact face of the head of the putter. If used with another type of club, the laser beam could be transmitted from the hosel essentially perpendicular to the longitudinal axis of the shaft and aimed in a horizontal direction parallel to the vertical plane in which the intended flight of the ball lies. When the laser beam strikes a chosen target, the person using the device is prompted to correct any perceived misalignment of the club in relation to the target. This will prompt the user to properly align the club in relation to a target.

The laser of the present invention emits a thin beam of light which is highly directional. The laser beam emitted by the device is in the visible spectrum of light. The stimulated emission of laser light in the preferred embodiment of the present invention is from a light-amplifying solid laser, preferably a semiconductor diode. A solid laser is preferred because of the repetitive impacts between the contact surface of the head, and golf balls. The solid laser is energized by one or more batteries inserted into compartments formed in the grip of the club at the proximal end of the shaft. The batteries may be rechargeable. Placement of the batteries in the grip adds weight at this point, which can improve the balance and stability of the club. As will be obvious to anyone of ordinary skill in the art, the source of laser light may also be a liquid or gaseous laser.

The distal end of the club shaft terminates in a fitting called a hosel, to which the head is attached. The shaft may be constructed of metal, wood or any suitable type of plastic. To enhance the ability of the user to grip the shaft, a hand grip is attached to the proximal end of the shaft. A switch mounted on the shaft protrudes through the hand grip. The switch may be constructed in the form of a trigger or pressure transducer. The switch is electrically connected to a printed circuit board within the shaft which energizes a laser generating assembly mounted within the hosel of the club.

The present invention can be used in connection with a target, or a target can be chosen from available structure at the practice site. The target preferably is a box. Vertical lines are scribed on the surface of the target facing the user of the device. The vertical lines are separated a distance substantially equal to the diameter of a standard golf cup on a putting green. The person using the device, whether indoors or out-of-doors, positions the target any distance up to approximately 100 feet away. The person then places a golf ball on the surface on which the person is standing. The person addresses the golf ball as if to stroke through the golf ball toward the target.

Before striking the ball, the person using the practice device switches on the laser light. The coherent laser light beam will be transmitted from the hosel of the club, and it will strike a point on the target. If the user has properly aligned the club with the target, the device will confirm proper alignment, and the user may stroke the ball toward the target. If the user has improperly aligned the club with the target, the user may switch off the laser light and readdress the ball.

The process may be repeated until the user is able to properly align the golf club with an intended target. As will be appreciated by those skilled in the art, the greater the distance the user is from the target, the smaller are permissible adjustments to alignment of the club with the target. Thus, a user is able to improve strokes through a wide range of distances from the target. As will also be appreciated by those of ordinary skill in the art, the target may be any item convenient to the user. An alternate embodiment of the target includes a foldable target made of relatively thin and lightweight materials. The target may be any number of shapes and sizes.

The present invention may be used either indoors or out-of-doors. Out-of-doors, the surface on which the user stands may be a contoured putting green on which the objective may be not to stroke directly through the ball to a target, but to adjust the alignment of the head of the club to compensate for the contours of the putting green. The present invention may be used to train the user to adjust for variations in ground surface contours.

The novel features of this invention, as well as the invention itself, will best be understood from the accompanying drawings, taken together with the accompanying description in which similar reference characters refer to similar parts, and in which:

DESCRIPTION OF PREFERRED EMBODIMENTS

Figure 1:
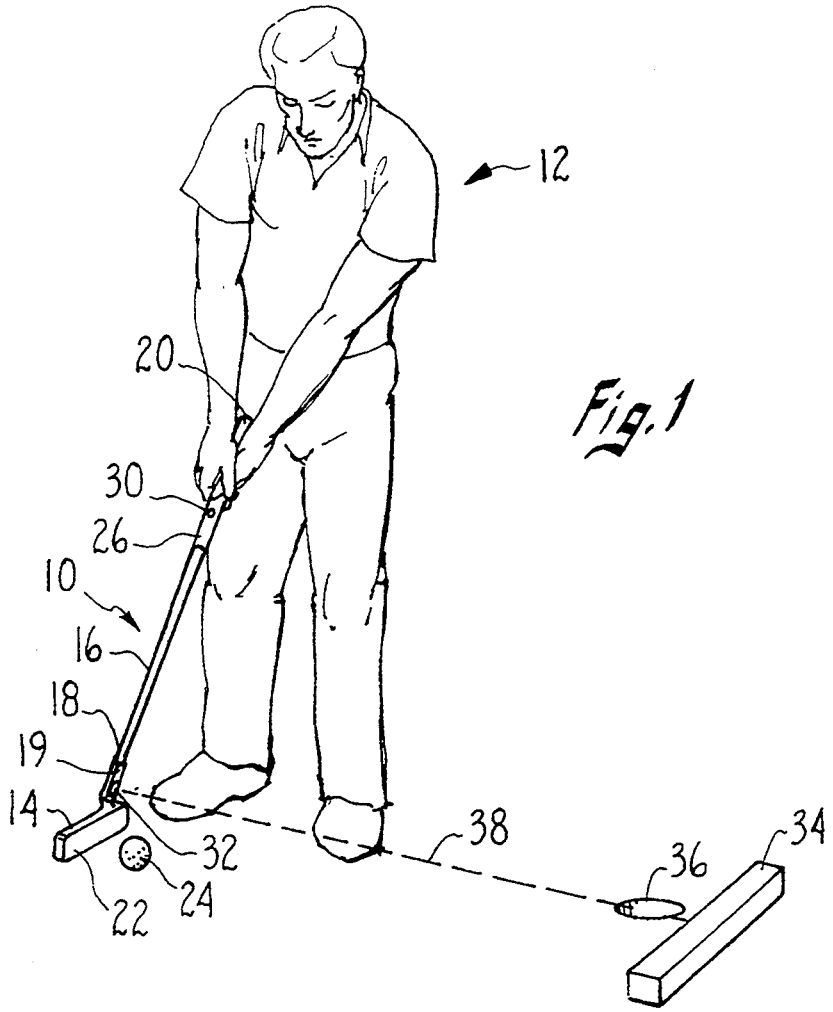
FIG. 1 is a perspective view of the preferred embodiment of the device of the present invention shown being used for its intended purpose.

Referring initially to FIG. 1, a device for allowing practice of the accurate alignment of a golf club, according to the present invention, is generally designated 10 and is shown operatively positioned in the hands of a golfer 12.

As shown in FIG. 1, device 10 includes a head 14 and a hollow longitudinal shaft 16 having a distal end 18 and a proximal end 20. Distal end 18 of shaft 16 terminates in a hosel 19, to which head 14 is attached. In accordance with the present invention, head 14 is formed with a contact surface 22 to strike a golf ball 24. A hollow tubular hand grip 26 is attached to shaft 16 at proximal end 20. Hand grip 26 is formed of any suitable material known in the art. A switch 30 is mounted on the shaft 16 at the grip 26. Switch 30 may be a rocker switch, a pressure sensitive switch, or any other suitable switch, preferably of the momentary contact type. As shown in FIG. 1, switch 30 protrudes through hand grip 26 for ease of operation by golfer 12.

As further shown in FIG. 1, a laser transmitting prism 32 is mounted on device 10. In the preferred embodiment of the present invention, laser transmitting prism 32 is mounted within a transverse recess or bore in hosel 19 of device 10. Contact surface 22 of head 14 is substantially perpendicular to the surface on which golfer 12 is standing. Laser light beam 38 is transmitted by prism 32 substantially perpendicular to the longitudinal axis of shaft 16 and perpendicular to the plane of contact surface 22 of head 14. If used with a club having an upwardly angled head, laser beam 38 would be substantially perpendicular to the longitudinal axis of shaft 16 and parallel to the vertical plane in which the ball is intended to travel as it leaves the ground. When the laser beam 38 strikes the target 34, golfer 12 is prompted to correct any perceived misalignment of device 10 in relation to target 34 and cup 36.

Figure 3:
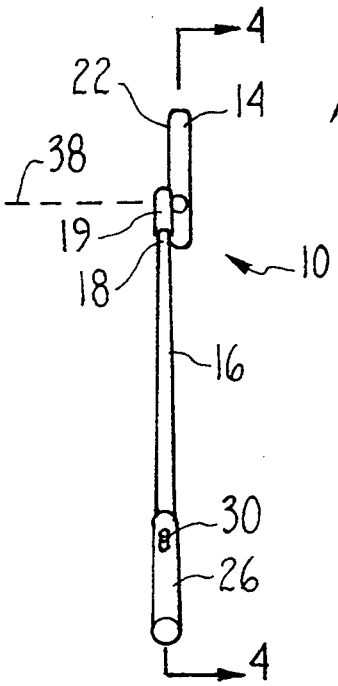
FIG. 3 is a plan view of the device shown in FIG. 1, showing the direction of transmission of the laser beam from the club.
Figure 2:
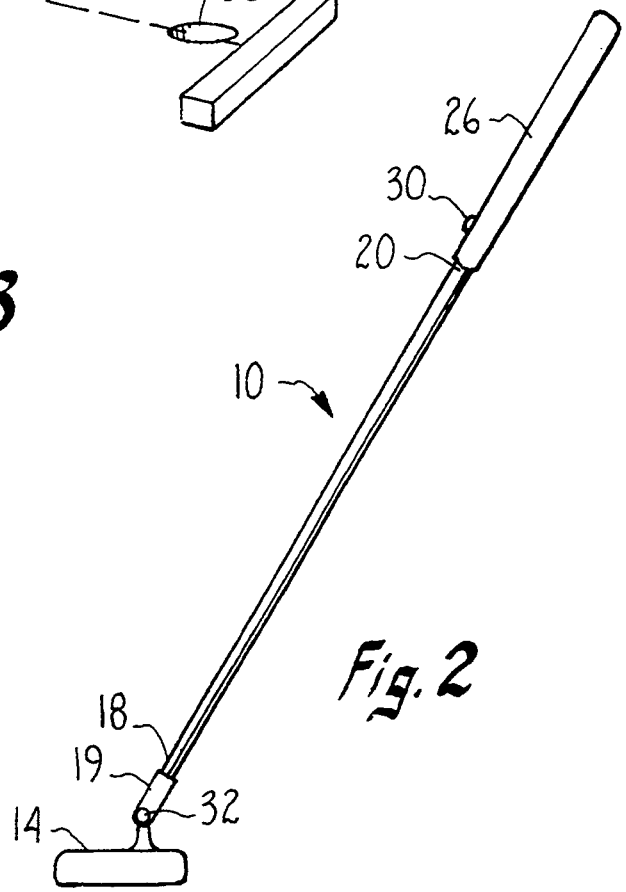
FIG. 2 is an elevation view of the device shown in FIG. 1.

Referring now to FIGS. 2 and 3, the preferred embodiment of the present invention, generally designated 10, is shown in an elevational view in FIG. 2 and in a plan view in FIG. 3. FIG. 2 shows head 14 of device 10 with laser transmitting prism 32 mounted within hosel 19. Distal end 18 of shaft 16 is attached to head 14 of device 10 by means of hosel 19. Hand grip 26 is attached at proximal end 20 of shaft 16. Switch 30 protrudes through hand grip 26 to be readily operable when in the hands of the person using device 10. Laser beam 38 is transmitted by prism 32, perpendicular to the longitudinal axis of shaft 16 and perpendicular to the plane of contact surface 22 of head 14.

Figures 4, 5:
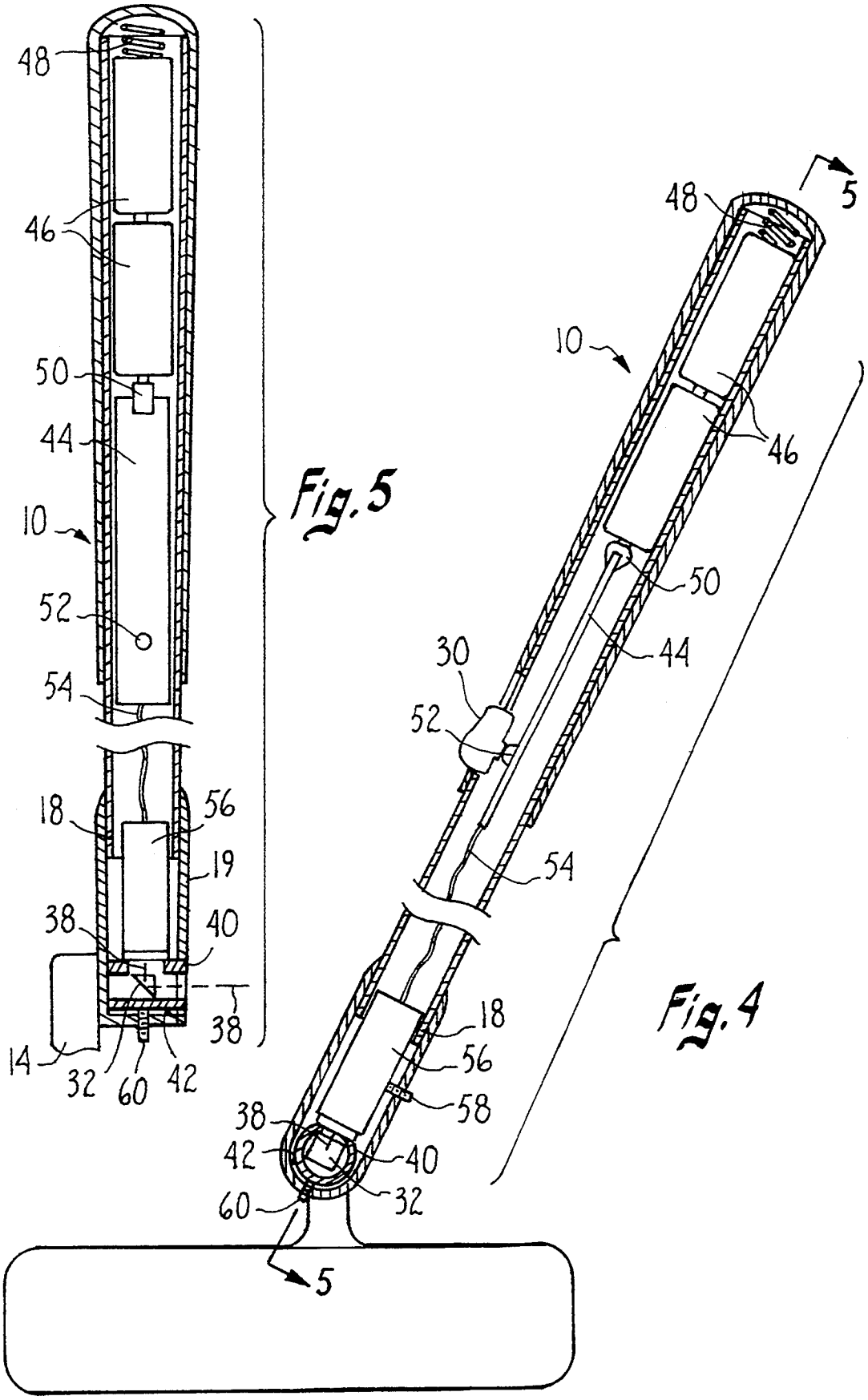
FIG. 4 is a longitudinal sectional view of the device shown in FIG. 1, taken along the line 4—4 in FIG. 3.
FIG. 5 is a partial longitudinal sectional view of the device shown in FIG. 1, taken along the line 5—5 in FIG. 4.

Referring now to FIGS. 4 and 5, device 10 is shown having a printed circuit board 44 mounted within the proximal end 20 of shaft 16. Also mounted within shaft 16 near proximal end 20 are batteries 46, and this end of shaft 16 is surrounded by grip 26. Batteries 46 are pressed between coil spring 48 and contact clip 50 on printed circuit board 44. Coil spring 48 is conductively connected to proximal end 20 of shaft 16. The components within shaft 16 are structurally mounted by means known in the art, which are not shown in the Figures, for the sake of clarity.

Switch 30 is mounted on shaft 16, protruding through grip 26, so as to align with contact 52 on circuit board 44 to complete the electrical circuit between batteries 46, circuit board 44, coil spring 48 and shaft 16. Wire 54 runs down the inside of shaft 16 to electrically connect the output of circuit board 44 with laser diode assembly 56. Printed circuit board 44 and laser diode assembly 56 are commercially available items well known in the art of laser generating equipment. Laser diode assembly 56 contains a laser emitting diode (not shown) and other components well known in the laser generating art, for proper generation of a thin, highly directional beam of light.

Laser diode assembly 56 is generally aligned with the longitudinal axis of shaft 16 and hosel 19. If accurate machining and alignment of the components are available, laser diode assembly 56 can be held in place by any suitable means known in the art, such as by set screw 58, which is threaded through hosel 19 transverse to the longitudinal axis thereof. The distal end of laser diode assembly 56 is directed toward the distal end of hosel 19, where laser transmitting prism 32 is mounted in a prism housing 40, in bore 42 within hosel 19. Bore 42 is substantially transverse to the longitudinal axis of shaft 16 and hosel 19. Laser transmitting prism 32 is a right angle prism with reflective coating on its hypotenuse. Prism housing 40 has an opening in its side wall to allow laser beam 38 to pass from laser diode assembly 56 to prism 32. Prism housing 40 also has a longitudinal bore which allows laser beam 38 to be reflected by prism 32 through a 90 degree angle and exit the hosel 19 perpendicular to the longitudinal axis of shaft 16.

If required, fine adjustment of the alignment of prism housing 40 and prism 32 can be accomplished by means of prism adjustment screw 60, which is threaded through the end of hosel 19 along the longitudinal axis of shaft 16. This adjustment could also be accomplished using a plurality of adjustment screws distributed radially around bore 42 in hosel 19 or axially along bore 42. Fine adjustment of the alignment of diode assembly 56 and prism 32 can be required to insure proper alignment of laser beam 38 as it is transmitted from hosel 19.

Laser beam 38 is highly directional, and it is in the visible spectrum of light. The stimulated emission of laser light beam 38 in the preferred embodiment of the present invention is from a light-amplifying solid laser, preferably a semiconductor diode. A solid laser is preferred because of repetitive impacts between contact surface 22 of head 14, and golf ball 24. As will be obvious to anyone of ordinary skill in the art, the source of laser light may also be liquid or gaseous lasers. Head 14 and shaft 16 of device 10 may be constructed of metal, wood or any suitable plastic.

OPERATION

Golfer 12, whether using device 10 indoors or out-of-doors, positions target 34 any distance up to approximately 100 feet away, behind a cup 36 if desired. Golfer 12 places golf ball 24 on the ground. Golfer 12 addresses golf ball 24 as if to stroke through the golf ball toward target 34. Before striking the ball, golfer 12 activates switch 30 to emit laser beam 38. Batteries 46 energize printed circuit board 44, which energizes laser diode assembly 56 to generate laser beam 38. The coherent laser beam 38 will strike transmitting prism 32, which will reflect beam 38 through a 90 degree angle and transmit beam 38 from hosel 19. Hopefully, beam 38 will strike target 34. If golfer 12 has properly aligned the club with target 34, device 10 will visually confirm proper alignment to golfer 12. Then golfer 12 may stroke golf ball 24 toward target 34. If golfer 12 has improperly aligned the club with target 34, golfer 12 may deactivate switch 30, thereby turning off laser diode assembly 56, and readdress ball 24. The process may be repeated until golfer 12 is able to properly align the club with target 34. As will be appreciated by those skilled in the art, the greater the distance between golfer 12 and target 34, the smaller are the permissible adjustments to alignment of the club with target 34. Thus, golfer 12 may practice putting strokes through a wide range of distances from target 34.

While the particular GOLF CLUB LASER ALIGNMENT DEVICE as disclosed in detail herein is fully capable of obtaining the objects and providing the advantages stated, it is to be understood that the disclosure is merely illustrative of the presently preferred embodiments of the invention, and that no limitations are intended to the details of construction or design shown other than as described in the appended claims.

We claim:

1. A golf club for practicing accurate alignment with a target, comprising:

a hollow longitudinal shaft;

a hollow hosel formed on a distal end of said shaft;

a laser diode assembly mountable within said hosel;

a prism assembly mountable within said hosel;

an adjustment means for selectively adjusting the alignment of said prism assembly;

wherein said laser diode assembly generates a laser beam which propagates substantially along a longitudinal axis of said shaft; and wherein said prism assembly receives said laser beam directly from said laser diode assembly and transmits said laser beam in a direction perpendicular to said longitudinal axis of said shaft.

2. A golf club as claimed in claim 1, wherein said laser diode assembly comprises:

a laser emitting diode; and a diode housing.

3. A golf club as claimed in claim 1, wherein said prism assembly comprises:

a right angle prism; and a prism housing.

4. A golf club as claimed in claim 1, wherein:

said adjustment means comprises a threaded member; and said threaded member is threaded into said hosel in a direction parallel to said longitudinal axis of said shaft.

5. A golf club for practicing accurate alignment with a target, comprising:

a hollow longitudinal shaft, said shaft having a distal end formed as a hosel;

a laser diode assembly mountable within said shaft;

a light deflecting assembly mounted at said distal end of said shaft, said light deflecting assembly comprising a prism mounted in said hosel; and an adjustment means for selectively adjusting the location of said prism along a longitudinal axis of said shaft;

wherein said laser diode assembly generates a laser beam which propagates substantially along said longitudinal axis of said shaft; and wherein said light deflecting assembly receives said laser beam directly from said laser diode assembly and transmits said laser beam in a direction perpendicular to said longitudinal axis of said shaft.

* * * * *